United States Patent [19]

Mott et al.

[11] Patent Number: 4,993,372

[45] Date of Patent: Feb. 19, 1991

[54] TWO STROKE INTERNAL COMBUSTION ENGINE WITH DECOMPRESSION VALVE

[76] Inventors: Constantin Mott, 10 Grenoble Dr., Apt. 812; Constantin Noe, 10 Grenoble Dr., Apt. PH16, both of Don Mills, Ontario M3C-1C7, Canada

[21] Appl. No.: 421,662

[22] Filed: Oct. 19, 1989

[51] Int. Cl.[5] ..... F02B 75/02

[52] U.S. Cl. ..... 123/65 BA; 123/65 VC; 123/182

[58] Field of Search ..... 123/65 BA, 65 VC, 65 W, 123/65 A, 65 P, 179 SE, 182

[56] References Cited

U.S. PATENT DOCUMENTS

| | | | |
|---|---|---|---|
| 2,958,315 | 11/1960 | Williams | 123/65 VC |
| 3,309,865 | 3/1967 | Kauffmann et al. | 123/65 VC |
| 3,540,421 | 11/1970 | Boyce et al. | 123/65 BA |
| 3,875,744 | 4/1975 | Brooks et al. | 123/65 E |
| 3,919,991 | 11/1975 | Neschke et al. | 123/182 |
| 4,028,892 | 6/1977 | Hinkle | 123/65 BA |
| 4,671,226 | 6/1987 | Van Rinsum | 123/323 |
| 4,791,892 | 12/1988 | Hall | 123/47 R |
| 4,817,388 | 4/1989 | Bland | 123/292 |

*Primary Examiner*—David A. Okonsky
*Attorney, Agent, or Firm*—Richard L. Miller

[57] ABSTRACT

A two-stroke internal combustion engine has an inlet port in the cylinder wall covered and exposed by the piston during reciprocation thereof in the cylinder and to which fresh air is supplied under pressure by a supercharger. An exhaust valve is mounted centrally in the cylinder head for controlled operation independently of the position of the piston. Fresh air forced into the cylinder by the supercharger when the inlet port is exposed by the piston during the exhaust stroke enables any residual unburned gases to burn completely and expels the gasses from the cylinder completely enabling operation of the engine at high compression with relatively low pollution.

2 Claims, 3 Drawing Sheets

TWO STROKE INTERNAL COMBUSTION ENGINE WITH DECOMPRESSION VALVE

BACKGROUND OF THE INVENTION

1. Field of the Invention

The invention relates to internal combustion engines of the two-stroke type.

2. Description of the Prior Art

In a conventional two-stroke internal combustion engine, permanently open inlet and exhaust ports are usually provided at axially spaced locations in the cylinder wall, the exhaust port being closer to the cylinder head so that the piston exposes the exhaust and inlet ports sequentially as it moves towards bottom dead center permitting burnt gas to exit and air and fuel to enter the exhaust and inlet ports, respectively. During the return stroke of the piston, the inlet and subsequently the exhaust ports are closed as the piston rises away from bottom dead center.

In one type of two-stroke internal combustion engine, known as the crank-case scavenged type, the crank-case is hermetically sealed with the cylinder and provides a pressure chamber from which a fuel and air mixture is forced into the cylinder through a port opened by the piston moving through bottom dead center. This arrangement suffers from the disadvantage that crank-case oil necessary for lubrication is also carried into the cylinder with the fuel causing an undesirable emission of pollutants.

In another known type of two-stroke engine, the fan-scavenged type, a fan or supercharger blows a fresh gas-and-air mixture into the cylinder while the inlet port is uncovered so that residual burnt gas is flushed out of the exhaust port. The need for lubricating oil to be mixed with the fuel is avoided as a separate lubrication system can be provided.

Both types, however, suffer from the disadvantage that the exhaust and inlet are permanently open ports so that the timing depends entirely on the piston position which results in operation at reduced efficiency.

Furthermore, an undesirable limitation is imposed on the maximum compression ratio that can be obtained in practice arising, for example, from the exhaust port remaining uncovered for a substantial distance of travel of the piston during the early stages of the compression stroke.

In the latter type, problems can also occur, however, from residual burning gas or hot spots possibly causing pre-ignition of the incoming fuel.

SUMMARY OF THE INVENTION

It is one object of the invention to provide a two-stroke engine which does not require lubricant to be mixed with the fuel and which overcomes or ameliorates the above-mentioned disadvantages.

According to the invention, a two-stroke internal combustion engine has an inlet means formed by a permanently open port positioned in the cylinder wall for exposure by a piston passing through bottom dead center to admit air into the cylinder during an exhaust and intake or admission cycle; a supercharger connected to the inlet port to supply air under pressure thereto; and, outlet means in the cylinder head formed by an exhaust valve controllable dependently of the piston for closure during the compression and combustion stroke and for opening during the entire time the inlet port is uncovered by the piston.

As a matter of practical adjustment, the exhaust valve is opened immediately before the piston exposes the inlet port during movement thereof to a bottom dead center condition to initiate the exhaust cycle reducing the pressure inside the cylinder to no greater than the air pressure in the inlet port and closed immediately after the inlet port is covered by the piston.

The engine according to the invention can therefore not only benefit from the advantage of an independent lubrication of the bearings enjoyed by a typical four-stroke engine and the fan-scavenged two-stroke but is also less polluting than the four-stroke engine as fresh air from the intake mixes with any residual unburnt gases in the cylinder which therefore continue to burn insuring both complete combustion and expulsion of burned gases from the cylinder.

In addition, as the timing of the exhaust valve can be varied independently of the position of the piston, for example, closed immediately after the inlet port is covered by the piston rather than at a time determined by the physical travel of the piston axially displaced from the inlet towards the head, (as with an exhaust port in a conventional two-stroke engine), optimum efficiency can be obtained and the shape of the combustion chamber can be such as to enable a very high compression ratio to be obtained.

In addition, injection of the fuel into the combustion chamber only towards the end of the compression stroke instead of at the beginning as in a fan-scavenged type reduces or eliminates the risk of pre-ignition.

In a preferred form of the engine, an intake valve is provided in the cylinder head which valve is operable, for example, by conventional electromechanical means to enable starting of the engine by release of the cylinder pressure and admittance of air into the cylinder and to remain closed while the engine is running.

BRIEF DESCRIPTION OF THE DRAWINGS FIGURES

The figures in the drawings are briefly described as follows.

DETAILED DESCRIPTION OF THE PREFERRED EMBODIMENT

Figure 1:
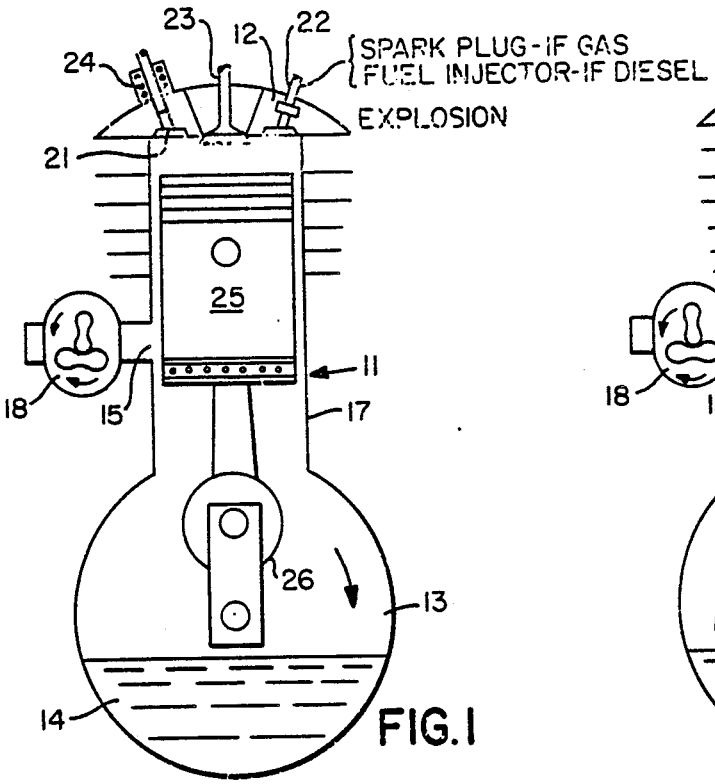
FIGS. 1, 2, 3 and 4 are diagrammatic views of the instant invention illustrated respectively in an explosion position, exhaust position, intake position and compression.

As schematically shown in FIGS. 1–4, a two-stroke internal combustion diesel engine includes a working cylinder 11 closed at the top by a cylinder head 12 and communicating at the bottom with a conventional crank case 13 containing lubricating oil 14. An inlet port is formed in the cylinder wall 17 to which port a supercharger 18 of conventional design supplies air under pressure. A compression release valve 21 and a conventional fuel injector 22 are mounted on opposite sides of the head and an exhaust valve 23 is mounted therebetween at a central location in the head. The compression release valve 21 is operated by conventional electromechanical means 24.

A conventional working piston 25 is mounted for reciprocation in the cylinder and connected at a bottom to a conventional crankshaft linkage 26.

In order to permit the engine to be turned over and started, with the exhaust valve in the closed position and the piston adjacent top dead center as shown in FIG. 1, the release valve is opened admitting air into the cylinder. The valve is subsequently closed throughout the entire period that the engine is running.

Figure 2:
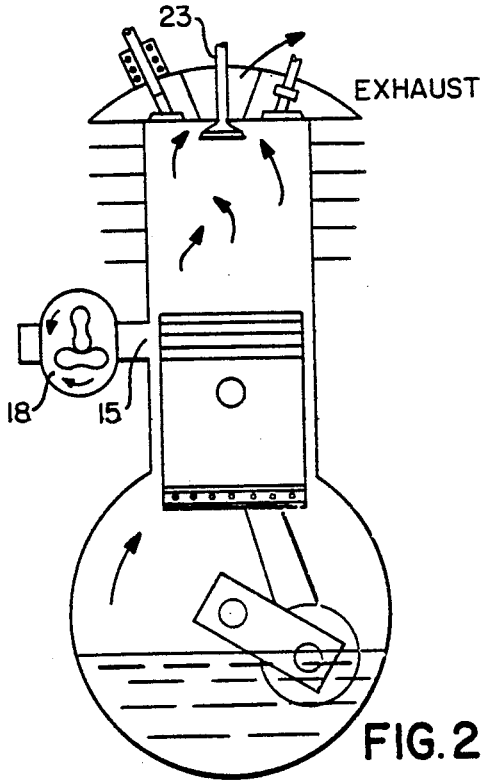
Figure 4:
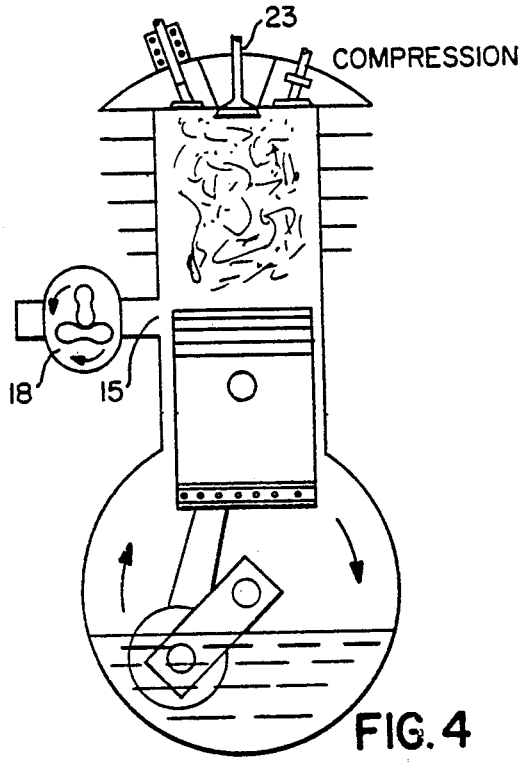
Figure 5:
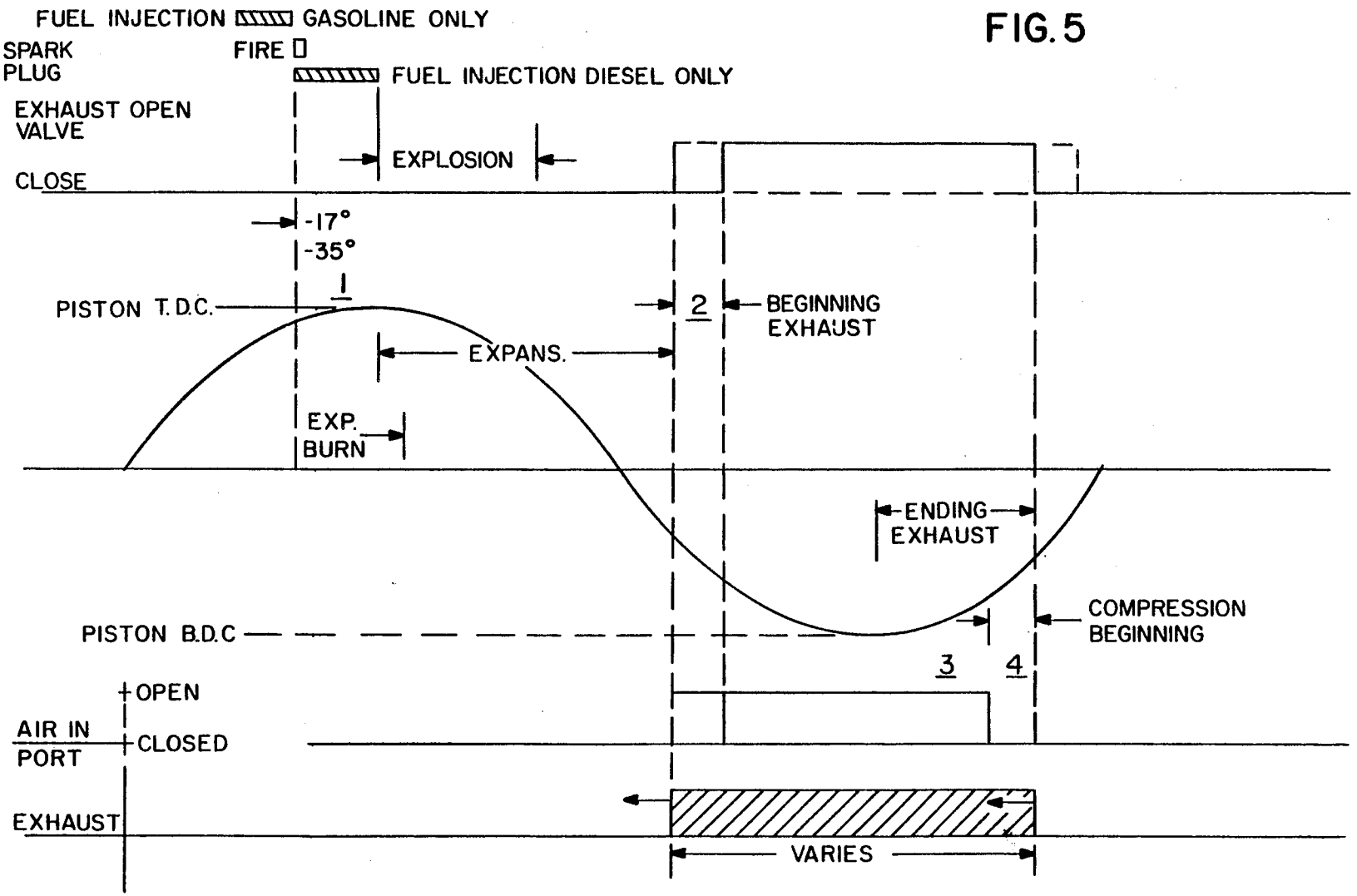
FIG. 5 is a graphic representation or timing diagram of the operating sequence according to the position of the engine piston with reference numerals indicating stages corresponding to those indicated in FIGS. 1–4 respectively.
Figure 6:
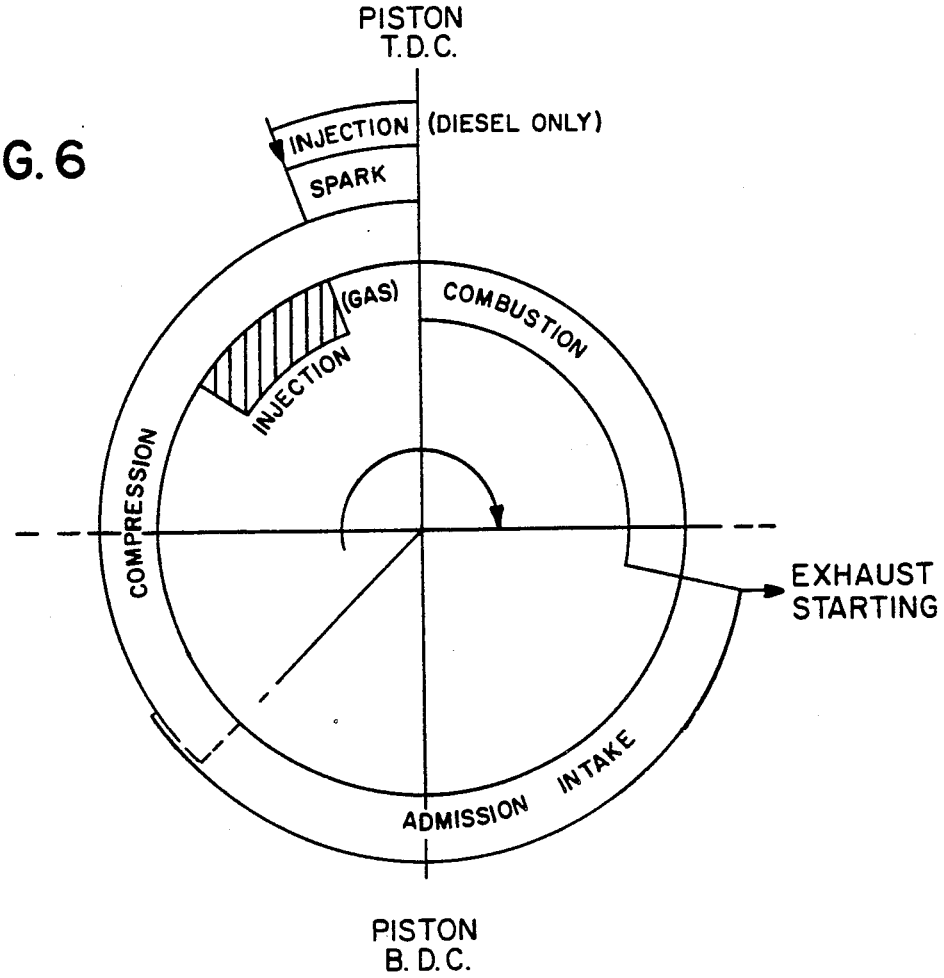
FIG. 6 is a polar graphic representation or timing diagram of the operating sequence according to the position of the engine piston.
Figure 7:
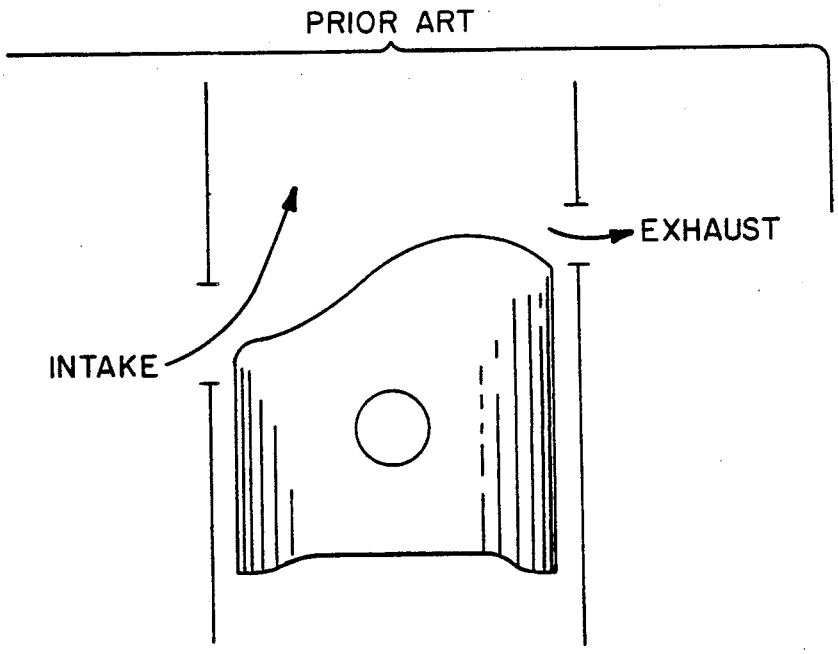
FIG. 7 shows a typical piston of a two-stroke engine of the prior art.

When the engine is running, during the compression stroke, as the piston is moving towards top dead center, fuel is injected into the combustion chamber by the fuel injector 22 shortly before the piston reaches top dead center (or earlier with spark ignition in the case of an alternative embodiment powered by gasoline), as shown in the fourth quadrant of FIG. 6 and the first quarter of the cycle of FIG. 5. At approximately top dead center, explosion of the mixture initiates the combustion stage shown, the first quadrant of FIG. 6 and the second quarter of FIG. 5. During further movement of the piston towards bottom dead center, immediately before the piston head exposes the upper level of the inlet port, the exhaust valve is opened so that the pressure of burnt gas will not exceed the inlet air pressure as shown in FIG. 2, FIG. 5 and the third quadrant of FIG. 6.

Subsequent exposure of the inlet port 15 enables the supercharger 18 to blow fresh air into the cylinder aiding both complete combustion of any residual unburned gases therein scouring the gases from the cylinder through the exhaust valve 23.

When the piston reaches bottom dead center (FIG. 3), air intake and exhaust continue and throughout the early stages of the piston's return towards top dead center as shown in the third quadrant of FIG. 6.

Figure 3:
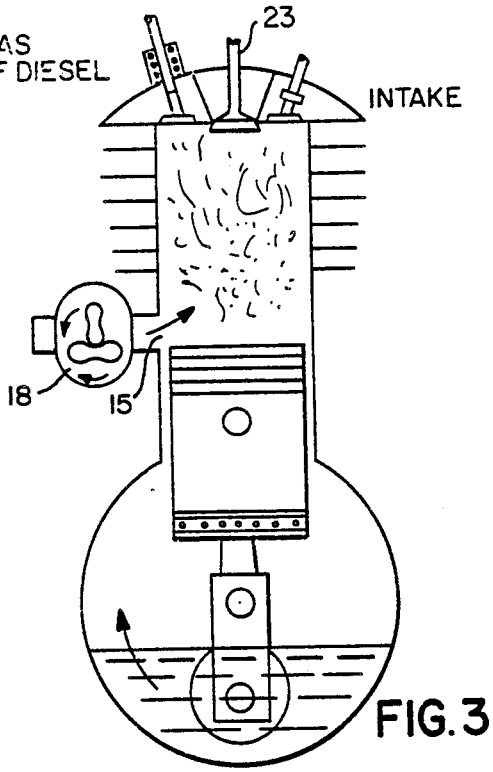

Intake of fresh air continues until the piston head covers the intake port and, simultaneously, or a short period of time later, the exhaust valve(s) closes, commencing the compression stroke, as shown in FIG. 3, third quadrant and FIG. 6.

As indicated in FIGS. 5 and 6, the precise timing of the opening and closing of the exhaust valve can be varied according to the particular running characteristic of the engine.

The engine is less polluting than existing four-stroke engines or fan-scavenged two-stroke engines, as fresh air forced into the inlet port by; the supercharger mixes with any unburned gases remaining in the chamber which therefore continue to burn ensuring the complete combustion before emission. At the same time a separate lubrication system similar to that used in four-stroke engines can be utilized obviating any requirement for oil injection into the fuel and the consequent pollution risk.

At the same time the engine can be manufactured of conventional materials and configured for any size and number of cylinders. High compression ratios can be obtained both as the design enables the provision of a relatively flat head and as the danger of pre-ignition is less than with fan-scavenged two-stroke engine, enabling high efficiency with relatively low pollution.

It should be added that the cooling of the piston is enhanced by the design of the inlet port.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A two-stroke internal combustion engine having an inlet means formed by a permanently open inlet port positioned in a cylinder wall for exposure by a piston passing through bottom dead center to admit air into the cylinder during exhaust and intake cycles; a supercharger connected to the inlet port for supplying fresh air under pressure thereto; and, outlet means in the cylinder head formed by an exhaust valve operable independently of the piston for closure during the compression and combustion stroke and for opening during the entire time the inlet port is uncovered by the piston wherein a decompression valve is mounted in the cylinder head and electromechanical means are provided for opening the decompression valve to enable starting of the engine by release of the cylinder pressure and admittance of air into the cylinder and for closure thereof while the engine is running.

2. A two-stroke internal combustion engine comprising:

a working cylinder having a cylinder head;

a working piston mounted for reciprocation in the cylinder between top dead center and bottom dead center; positions;

a compression release valve mounted in the cylinder head;

electromechanical means for opening the compression release valve for starting the engine and for closing the compression release valve while the engine is running;

means in the cylinder head for injecting fuel into the cylinder;

an air inlet formed by an inlet port in the cylinder wall at a location remote from the cylinder head;

supercharging means for supplying air under pressure to the inlet; and an outlet formed by an exhaust valve in the cylinder head operable remotely from the piston;

whereby the exhaust valve can be closed during the compression and combustion cycle and opened during the entire period that the inlet port is uncovered by the piston while the piston passes through bottom dead center.

* * * * *